US010092941B2

(12) United States Patent
Ogishi et al.

(10) Patent No.: US 10,092,941 B2
(45) Date of Patent: Oct. 9, 2018

(54) SPINNING FORMING APPARATUS AND FORMING METHOD

(71) Applicant: KAWASAKI JUKOGYO KABUSHIKI KAISHA, Kobe-shi, Hyogo (JP)

(72) Inventors: Hideyuki Ogishi, Akashi (JP); Hayato Iwasaki, Kobe (JP); Yoshihide Imamura, Kobe (JP); Yuto Sakane, Kobe (JP); Toshiro Tsuji, Kakogawa (JP); Hiroshi Kitano, Kobe (JP); Kazunori Hara, Kakogawa (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 888 days.

(21) Appl. No.: 14/420,701

(22) PCT Filed: Jul. 17, 2013

(86) PCT No.: PCT/JP2013/004373
§ 371 (c)(1),
(2) Date: Feb. 10, 2015

(87) PCT Pub. No.: WO2014/024384
PCT Pub. Date: Feb. 13, 2014

(65) Prior Publication Data

US 2015/0202677 A1 Jul. 23, 2015

(30) Foreign Application Priority Data

Aug. 10, 2012 (JP) ..... 2012-178269

(51) Int. Cl.
*B21K 29/00* (2006.01)
*B21D 37/16* (2006.01)
(Continued)

(52) U.S. Cl.
CPC ..... *B21D 37/16* (2013.01); *B21C 51/00* (2013.01); *B21D 22/16* (2013.01); *B21D 22/18* (2013.01)

(58) Field of Classification Search
CPC ..... B21D 37/16; B21D 51/00; B21D 22/16; B21D 22/18; B21D 22/14; H05B 6/102
(Continued)

(56) References Cited

U.S. PATENT DOCUMENTS 438,406 A 10/1890 Dewey
3,815,395 A 6/1974 Sass
(Continued)

FOREIGN PATENT DOCUMENTS

DE 19545177 A1 8/1996
EP 1 481 744 A1 12/2004
(Continued)

OTHER PUBLICATIONS

Jul. 28, 2015 Office Action issued in Chinese Patent Application No. 201380039028.X.
(Continued)

*Primary Examiner* — David B Jones
(74) *Attorney, Agent, or Firm* — Oliff PLC

(57) ABSTRACT

A spinning forming apparatus shapes a plate while rotating the plate around a rotational axis. The spinning forming apparatus includes: a holding member to which the plate is attached and which rotates the plate around the rotational axis; a processing tool configured to contact a first main surface of the plate to process and shape the plate; and a heater configured to heat the plate. The heater is arranged at the opposite side of the processing tool across the plate. The heater locally heats a position of a second main surface of the plate opposite to the first main surface, the position being located on a circumference around the rotational axis, the
(Continued)

circumference being defined by a position, with which the processing tool contacts, of the plate.

19 Claims, 6 Drawing Sheets

(51) Int. Cl.
*B21D 22/18* (2006.01)
*B21C 51/00* (2006.01)
*B21D 22/16* (2006.01)

(58) Field of Classification Search
USPC ..... 72/69, 19.1
See application file for complete search history.

(56) References Cited

U.S. PATENT DOCUMENTS 6,199,419 B1 3/2001 Shrayer et al.
7,454,936 B2 * 11/2008 Michel ..... B21D 22/185 72/342.1
2004/0226333 A1 11/2004 Kato et al.
2015/0202677 A1 * 7/2015 Ogishi ..... B21D 22/18 72/19.1
2015/0328673 A1 * 11/2015 Imamura ..... B21D 22/18 72/82
2016/0101455 A1 * 4/2016 Sakane ..... B21D 22/14 72/80

FOREIGN PATENT DOCUMENTS

JP 2007283365 A 11/2007
JP 2011218427 A 11/2011

OTHER PUBLICATIONS

Translation of Oct. 15, 2013 International Search Report issued in International Patent Application No. PCT/JP2013/004373.
Dec. 4, 2015 Search Report issued in European Patent Application No. 13827196.0.

* cited by examiner

SPINNING FORMING APPARATUS AND FORMING METHOD

TECHNICAL FIELD

The present invention relates to a spinning forming apparatus and a spinning forming method, in each of which shapes a plate while rotating the plate around a rotational axis.

BACKGROUND ART

Conventionally known is a spinning forming method of processing and shaping a plate, made of an iron material, an aluminum alloy, or pure titanium, by causing a processing tool to contact the plate while rotating the plate around a predetermined rotational axis.

Even in the case of materials, such as a titanium alloy, which are considered to be difficult to process, the application of the spinning forming method of processing the plate is desired instead of cut processing of forged products in order to reduce a material cost and a processing cost. For example, the titanium alloy, such as Ti-6Al-4V, is high in yield strength and is low in ductility at normal temperature. Therefore, if a conventionally general cold (normal-temperature) spinning forming method is directly applied to the titanium alloy, the material cracks and cannot be shaped successfully. On this account, a hot spinning forming needs to be performed by heating the plate.

The hot spinning forming is disclosed in, for example, PTL 1. According to the configuration in PTL 1, a surface of the plate is heated by a burner, and the plate is then processed.

According to the hot spinning forming using the burner as in PTL 1, the plate is heated extensively. Therefore, even non-shaped portions, such as not-yet-shaped portions, already-shaped portions, and never-shaped portions, of the plate are heated. On this account, there are problems that depending on the material and shape (especially, thickness) of the plate, by stress generated at the time of processing, the not-yet-shaped portion of the plate deforms, so that highly accurate processing cannot be performed, and the already-shaped portion of the plate cracks.

Here, a configuration of PTL 2 is proposed as a spinning forming apparatus that locally heats a position close to a shaping target portion. According to the configuration of PTL 2, a high frequency induction heating coil that is the heater is arranged from between a spatula that is the processing tool and a not-yet-shaped side portion of the plate toward a position where the processing tool and the plate contact each other.

CITATION LIST

Patent Literature

PTL 1: Japanese Laid-Open Patent Application Publication No. 2007-283365

PTL 2: Japanese Laid-Open Patent Application Publication No. 2011-218427

SUMMARY OF INVENTION

Technical Problem

However, in the configuration of PTL 2, since a tip end portion of the high frequency induction heating coil that is the heater is positioned between the spatula that is the processing tool and the not-yet-shaped side portion of the plate, the following problems occur. To be specific, since the arrangement position of the heater is restricted by the operations of the processing tool, the heater cannot be arranged at a position most appropriate for local heating, so that the shaping target portion cannot be appropriately heated. In addition, the configuration of PTL 2 presupposes that the plate is shaped along the shape of a mandrel that is a shaping die. Therefore, there may be a problem that since the shaping target portion of the plate contacts the mandrel, the heat for heating the plate is transferred to the mandrel to be deprived, so that the temperature of the plate does not adequately increase (heating loss is large), and the plate cracks.

The present invention was made to solve the above problems, and an object of the present invention is to provide a spinning forming apparatus and a spinning forming method, each of which is capable of shaping the plate without causing deformations or cracks of the plate by appropriately heating the shaping target portion of the plate.

Solution to Problem

To solve the above problems, the inventors of the present invention have diligently studied, and as a result, found that when locally heating a specific plate, such as a titanium alloy plate or a thick stainless steel plate, the stiffness of the plate is secured by a non-heated portion of the plate, so that the plate can be shaped to have a desired shape without using a shaping die. The present invention was made from this point of view.

A spinning forming apparatus according to one aspect of the present invention is a spinning forming apparatus configured to shape a target plate while rotating the plate around a rotational axis, the spinning forming apparatus including: a holding member including a receiving jig to which the plate is attached and a rotational shaft configured to rotate the plate around the rotational axis together with the receiving jig; a processing tool configured to contact a first main surface of the plate to process and shape the plate; and a heater configured to heat the plate, wherein: the heater is arranged at the opposite side of the processing tool across the plate; and the heater locally heats a position of a second main surface of the plate opposite to the first main surface, the position being located on a circumference around the rotational axis, the circumference being defined by a position, with which the processing tool contacts, of the plate.

According to the above configuration, since the receiving jig is used instead of the shaping die, a space can be secured on the opposite side of the processing tool across the shaping target portion of the plate, and the heater can be arranged in this space. As a result, the heater locally heats the second main surface of the plate which is the opposite side of the first main surface with which the processing tool contacts, so that the shaping target portion of the plate can be appropriately heated regardless of the positional relationship between the processing tool and the plate. In addition, since the plate is attached to the receiving jig that is not the shaping die, the shaping target portion does not contact the receiving jig. Therefore, the heat by the heating is not directly transferred to the receiving jig, so that the heating can be performed more efficiently than a case where the shaping die is used. On this account, the shaping can be performed without causing deformations or cracks of the plate.

The spinning forming apparatus may be configured such that the receiving jig has a size smaller than a circle defined by a shaping start position of the plate. With this, the heating can be appropriately performed from the shaping start position.

The spinning forming apparatus may be configured such that the heater performs heating by high frequency induction heating. With this, the local heating can be performed easily and efficiently.

The spinning forming apparatus may include a preheater configured to preliminarily heat a position of the plate, the position being located at a radially outer side of the position with which the processing tool contacts. With this, the shaping speed can be increased, or even in a case where the plate is thick, the heating up to the temperature required for the shaping can be efficiently performed without decreasing the shaping speed.

The spinning forming apparatus may be configured such that the heater includes a coil formed to have a circular-arc shape that is doubled in a direction perpendicular to the rotational axis. With this, the heater can further efficiently heat the position on the circumference defined by the shaping target portion.

The spinning forming apparatus may be configured such that the heater includes: a magnetic core covering the coil from the opposite side of the plate; and a non-magnetic convex portion projecting toward the plate beyond the coil and the core. With this, by causing the core covered with the coil to prevent the magnetic flux, generated by the coil, from leaking to the outside, the magnetic flux is concentrated. Thus, the heat can be generated more locally and efficiently. Further, the non-magnetic convex portion can prevent the coil and the core from contacting the plate. As a result, the electric short circuit of the coil can be prevented, and a portion, facing the core, of the second main surface of the plate can obtain a high skin effect.

The spinning forming apparatus may include an auxiliary tool configured to support a position of the plate, the position being located at a radially outer side of the position with which the processing tool contacts. With this, the plate can be stabilized and can be efficiently heated and shaped.

The spinning forming apparatus may include a control device programmed to move the heater relative to the plate such that a distance between the heater and a shaping target portion of the plate becomes a predetermined distance. With this, even in a case where the plate is displaced in a direction along the rotational axis of the holding member at the time of the shaping, the distance between the heater and the shaping target portion (heating target portion) of the plate can be maintained constant. Therefore, the heating with respect to the shaping target portion of the plate at the time of the shaping can be made constant regardless of a shaping state.

The spinning forming apparatus may include a control device programmed to move the heater in synchronization with a shaping operation by the processing tool. With this, since the heater moves in accordance with the shaping operation by the processing tool, the shaping can be stably performed. In addition, since the shaping by the processing tool can be performed after the heater surely heats the shaping target portion, an excellent shaped product can be obtained.

The spinning forming apparatus may include: a radiation thermometer configured to measure a surface temperature of a position of the plate, the position being located on the circumference around the rotational axis, the circumference being defined by the position with which the processing tool contacts; and an output adjuster configured to adjust an output of the heater, wherein the output adjuster adjusts the output of the heater such that the surface temperature falls within a predetermined temperature range. With this, the output of the heater is adjusted based on the actual temperature of the shaping target portion of the plate, so that the temperature of the shaping target portion of the plate can be adjusted more appropriately.

The spinning forming apparatus may include: a load measuring unit configured to measure a load applied to the plate when the processing tool contacts the plate; and a control device programmed to move the processing tool relative to the plate at a feed speed corresponding to the load. In a case where the feed speed of the processing tool with respect to the plate when rotating the plate is high, the shaping speed becomes high, but the load becomes large, and this increases risks of deformations and cracks. In contrast, in a case where the feed speed is low, the load becomes small, but the shaping speed becomes low. Therefore, by controlling the feed speed of the processing tool such that the load falls within a predetermined range, the shaping can be appropriately performed without decreasing the shaping speed as much as possible.

The spinning forming apparatus may be configured such that the plate is made of a titanium alloy, for example.

A spinning forming method according to another aspect of the present invention is a spinning forming method of shaping a plate while rotating the plate around a rotational axis, the method including: when a processing tool is caused to contact a first main surface of the plate to process and shape the plate in a state where the plate is attached to a receiving jig of a holding member, and the plate is rotated around the rotational axis, arranging a heater at the opposite side of the processing tool across the plate; and locally heating a position of a second main surface of the plate opposite to the first main surface, the position being located on a circumference around the rotational axis, the circumference being defined by a position, with which the processing tool contacts, of the plate.

According to the above method, since the receiving jig is used instead of the shaping die, a space can be secured on the opposite side of the processing tool across the shaping target portion of the plate, and the heater can be arranged in this space. As a result, the heater locally heats the second main surface of the plate which is the opposite side of the first main surface with which the processing tool contacts, so that the shaping target portion of the plate can be appropriately heated regardless of the positional relationship between the processing tool and the plate. In addition, since the plate is attached to the receiving jig that is not the shaping die, the shaping target portion does not contact the receiving jig. Therefore, the heat by the heating is not directly transferred to the receiving jig, so that the heating can be performed more efficiently than a case where the shaping die is used. On this account, the shaping can be performed without causing deformations or cracks of the plate.

Advantageous Effects of Invention

The present invention is configured as explained above and has an effect of being able to shape the plate without causing deformations or cracks of the plate by appropriately heating the shaping target portion of the plate.

DESCRIPTION OF EMBODIMENTS

Hereinafter, embodiments of the present invention will be explained in reference to the drawings. In the following explanations and drawings, the same reference signs are used for the same or corresponding components, and a repetition of the same explanation is avoided.

Embodiment 1

Figure 1:
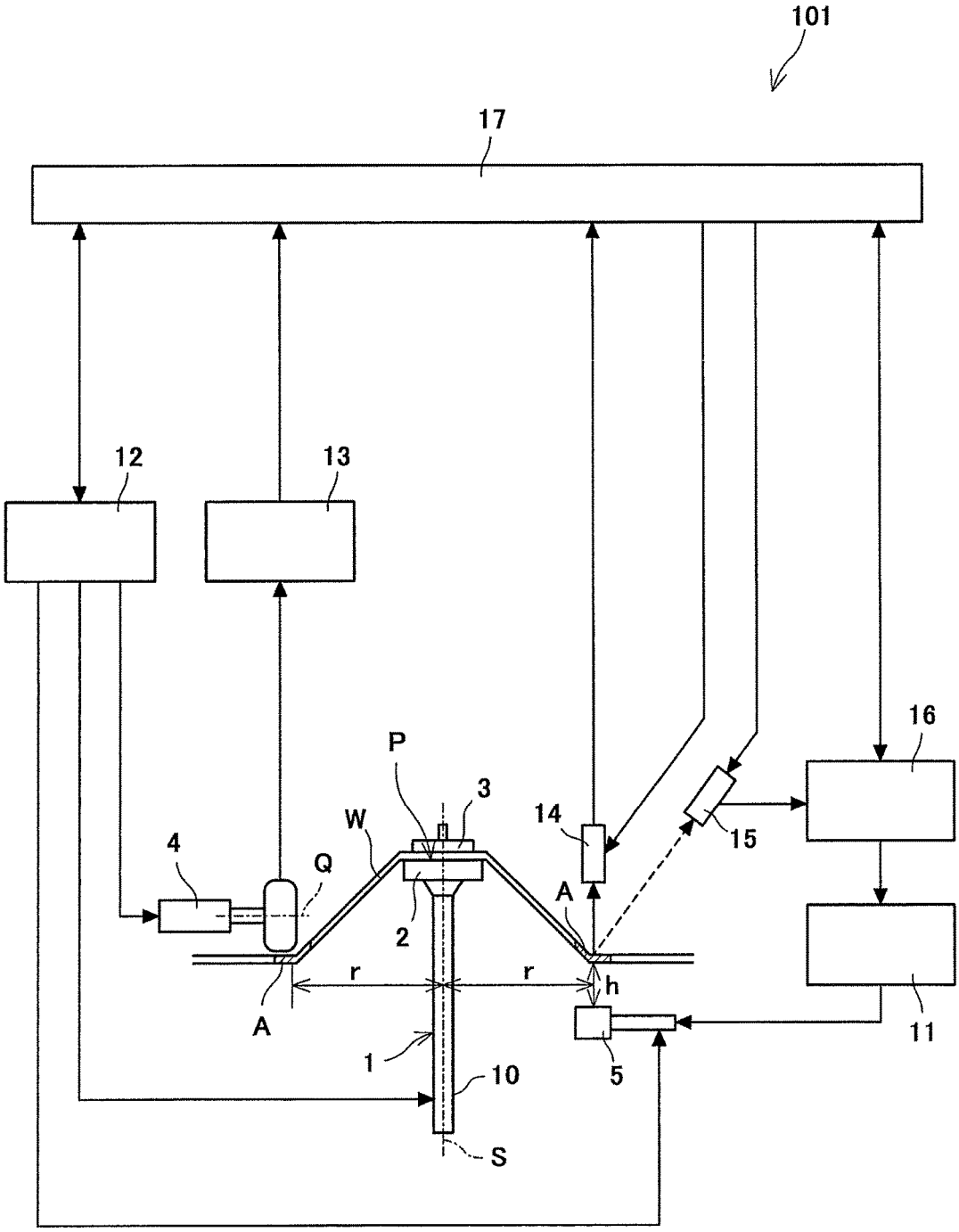
FIG. 1 is a schematic configuration diagram showing a spinning forming apparatus according to Embodiment 1 of the present invention.

FIG. 1 is a schematic configuration diagram showing a spinning forming apparatus according to Embodiment 1 of the present invention. As shown in FIG. 1, a spinning forming apparatus 101 of the present embodiment includes a holding member 1 configured to rotate a plate W around a rotational axis S. In the present embodiment, the rotational axis S extends in a vertical direction. However, the direction in which the rotational axis S extends may be a horizontal direction or an oblique direction.

The plate W that is a shaping target material is attached to the holding member 1 without via a shaping die. More specifically, the holding member 1 includes: a receiving jig 2 having a receiving surface P substantially perpendicular to the rotational axis S; and a rotational shaft 10 to which the receiving jig 2 is attached so as not to be relatively rotatable and which rotates the plate W together with the receiving jig 2. The above-described rotational axis S is a central axis of the rotational shaft 10. The plate W is attached onto the receiving surface P of the receiving jig 2. To be specific, the plate W is arranged so as to intersect with the rotational axis S substantially perpendicularly. The plate W is fixed to the receiving surface P by a fixing jig 3 provided above the plate W so as to face the receiving surface P of the receiving jig 2. With this, when the rotational shaft 10 of the holding member 1 rotates around the rotational axis S, the plate W rotates around the rotational axis S.

It should be noted that the plate W in the present specification is not limited to a flat plate. For example, the plate W may be: a plate, at least a part of which has a curved surface; or a plate that is bent in advance (i.e., a material in the middle of shaping or a material after shaping). In addition, the plate W may be a plate, a part of which is different in thickness from the other part, such as a plate to which another plate is partially attached or a plate integrated with another plate by casting.

The material of the plate W is not especially limited. A metal material that is difficult to be subjected to cold processing is preferable. Examples of such metal material include a titanium alloy, a nickel-based alloy, a cobalt-based alloy, high-strength steel, high-strength stainless steel, and a magnesium alloy. Especially in the case of a material, such as the titanium alloy, whose difference between the yield strength at a normal temperature and the yield strength at a high temperature (shaping temperature) is large, cracks and deformations easily occur by conventional methods. Therefore, when shaping such material, the application of the present embodiment is effective. It should be noted that the present embodiment is also applicable to metal materials, such as an aluminum alloy and pure titanium, which can be subjected to the cold processing. When the plate made of the metal material which can be subjected to the cold processing is thick, the application of the present embodiment is effective.

Examples of the titanium alloy include anticorrosion alloys (such as Ti-0.15Pd), $\alpha$ alloys (such as Ti-5Al-2.5Sn), $\alpha+\beta$ alloys (such as Ti-6Al-4V), and $\beta$ alloys (Ti-15V-3Cr-3Sn-3Al).

The spinning forming apparatus 101 further includes: a processing tool 4 configured to contact a first main surface of the plate W, attached to the receiving jig 2, to process and shape the plate; and a heater 5 configured to heat the plate W. In the present embodiment, the first main surface with which the processing tool 4 contacts is an upper surface, and a second main surface opposite to the first main surface is a lower surface. However, the first main surface and the second main surface may be respectively the lower surface and the upper surface. The heater 5 is arranged at the opposite side of the processing tool 4 across the plate W. The heater 5 locally heats a position of the second main surface of the plate W, the position being located on a circumference around the rotational axis S, the circumference being defined by a position, with which the processing tool 4 contacts, of the plate W. It should be noted that when, for example, a distance between the rotational axis S and the position, with which the processing tool 4 contacts, of the plate W is denoted by r, the term "circumference" means a region where a distance between the rotational axis S and the position heated by the heater 5 is denoted by r±10%.

In the present embodiment, the receiving jig 2 is a flat, disc-shaped plate. However, the receiving jig 2 is not necessarily flat. For example, in a case where the plate W has a bowl shape, a middle of the receiving surface P may be bulged or depressed depending on the orientation of the plate W. Or, for example, the receiving jig 2 may have a parallel-cross shape formed by assembling a plurality of bars crossways. Further, the following configuration may be employed, in which: the plate W is provided with one or a plurality of through holes in a region overlapping with the receiving jig 2; and a positioning pin(s) that fits in the through hole(s) is formed on the receiving surface P of the receiving jig 2.

The receiving jig 2 may be the same in size as a circle defined by a shaping start position of the plate W. However, it is desirable that the receiving jig 2 be smaller in size than the circle. To be specific, it is desirable that a peripheral portion of the receiving jig 2 be spaced apart from the shaping start position of the plate W in a radially inward direction such that the heater 5 can be provided immediately under the shaping start position of the plate W.

In the present embodiment, as shown in FIG. 1, one processing tool 4 is included. However, the configuration is not limited to this, and a plurality of processing tools 4 may be included. In this case, the processing tools are arranged so as to contact the first main surface of the plate W. Further, for example, the processing tools may be arranged on the same circumference around the rotational axis S so as to be separated from each other by 180° around the rotational axis S. In a case where a side where the processing tool 4 is located is regarded as a front surface side of the plate W, the heater 5 is provided at a rear surface side of the plate W.

Figure 2A:
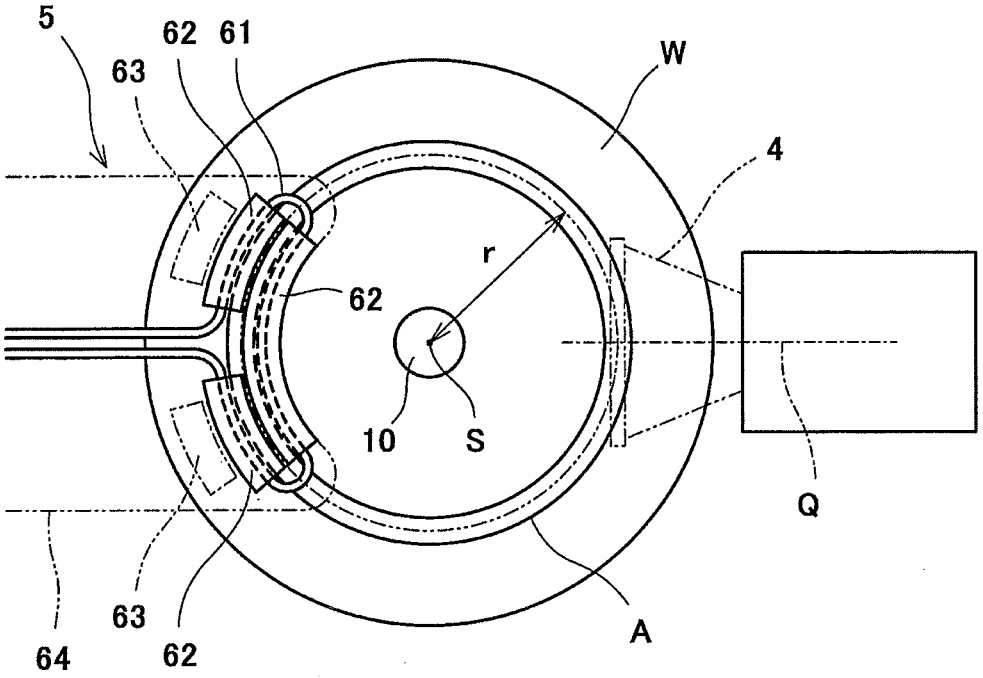
FIG. 2A is a bottom view showing a relationship among a rotational axis, a processing tool, and a heater in the spinning forming apparatus of FIG. 1.

FIG. 2A is a diagram showing a relationship among the rotational axis, the processing tool, and the heater in the spinning forming apparatus of FIG. 1. It should be noted that FIG. 2A is a bottom view when viewed from the rear surface side (side where the heater is located) of the plate, and the components other than the rotational shaft 10, the processing tool 4, the heater 5, and the plate W shown in FIG. 1 are not shown in FIG. 2A. In the present embodiment, the processing tool 4 includes a processing roller configured to rotate around a rotational axis Q that forms a predetermined angle (about 90° in the example of FIG. 1) relative to the rotational axis S. The processing tool 4 is located at the front surface side of the plate W, and when the processing roller configured to rotate around the rotational axis Q contacts the first main surface of the plate W, the plate W is subjected to ironing or drawing. The heater 5 is located at the rear surface side of the plate W. Both the processing tool 4 and the heater 5 are independently movable three-dimensionally (at least in an axial direction and radial direction of the rotational axis S) relative to the holding member 1, and the positions of the processing tool 4 and the heater 5 are controlled such that each of a distance from the rotational axis S to the processing tool 4 and a distance from the rotational axis S to the heater 5 becomes the distance r (r is variable). It should be noted that the processing tool 4 is not limited to the tool including the processing roller and may be a processing tool including a spatula, for example.

The heater 5 includes a coil 61 configured to heat the second main surface of the plate W by high frequency induction heating. The high frequency induction heating denotes induction heating whose frequency is, for example, 5 kHz to 400 kHz. A current is supplied from an induction heating power supply 11 to the coil 61. In the present embodiment, the heater 5 is located at a position symmetrical to the processing tool 4 across the rotational axis S (holding member 1) in plan view (i.e., at a position separated from the processing tool 4 in a circumferential direction around the rotational axis S by an angle θ that is 180° around the rotational axis S). It should be noted that the position of the heater 5 is not limited to this as long as the heater 5 can locally heat a position of the second main surface of the plate W, the second main surface being located at one side of the plate W, the side being opposite to the other side with which the processing tool 4 contacts, the position being located on a circumference around the rotational axis S, the circumference being defined by the position, with which the processing tool 4 contacts, of the plate W. For example, the heater 5 may be provided such that in plan view, a center angle θ between the heater 5 and the processing tool 4 (i.e., an angle between a line connecting the heater 5 and a central axis S and a line connecting the processing tool 4 and the central axis S in the circumferential direction) becomes a predetermined angle (0° θ<360°).

Figure 2B:
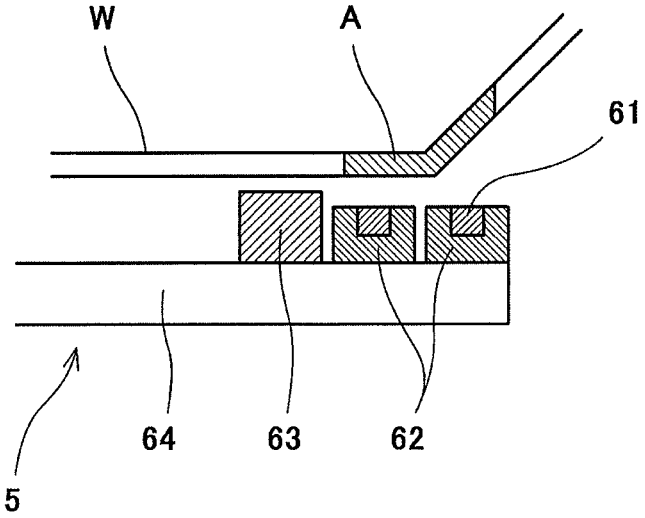
FIG. 2B is a cross-sectional view of the heater.

The coil 61 of the heater 5 is formed to have a circular-arc shape that is doubled in a direction perpendicular to the rotational axis S. Specifically, the coil 61 includes an inner circular-arc portion and an outer circular-arc portion parallel to each other. As shown in FIG. 2B, the heater 5 includes: cores 62 individually covering the inner circular-arc portion and outer circular-arc portion of the coil 61 from the opposite side of the plate W; a base plate 64 supporting the cores 62; and convex portions 63 provided at the base plate 64 so as to be located at a radially outer side of the cores 62. The cores 62 are magnetic bodies and collect magnetic flux generated around the circular-arc portions of the coil 61. The convex portions 63 are non-magnetic bodies and project toward the plate W beyond the coil 61 and the cores 62. Since the convex portions 63 are provided as above, the convex portions 63 can prevent the coil 61 and the cores 62 from contacting the plate W. As a result, electric short circuit of the coil 61 can be prevented, and portions, facing the cores 62, of the second main surface of the plate W can obtain a high skin effect. In order to prevent the electric short circuit of the coil 61, electric insulating paint may be applied to the surface of the coil 61.

The coil 61 of the heater 5 is formed in a crescent shape such that an angle formed by both circular-arc end portions of the coil 61 and the rotational axis S in the circumferential direction becomes substantially 90°. With this, the heater 5 can efficiently heat the portion on the circumference around the rotational axis S, the circumference being defined by the shaping target portion A. It should be noted that the shape of the coil 61 is not limited to this. The angle formed by both circular-arc end portions and the rotational axis S in the circumferential direction may be an angle other than 90°. A part of the circular-arc shape may include a linear portion. The coil 61 may be formed so as to include the combination of linear lines (may be formed in the shape of a polygonal line). Instead of the coil 61 having the circular-arc shape, coils (cylindrical multiple-winding coils) each obtained by winding a wire multiple times in a circular shape may be arranged in a circular-arc shape, or a single cylindrical multiple-winding coil may be used as the coil of the heater 5.

According to the spinning forming apparatus 101 configured as above, since the receiving jig 2 is used instead of the shaping die, a space can be secured on the opposite side of the processing tool 4 across the shaping target portion A of the plate W, and the heater 5 can be arranged in this space. As a result, the heater 5 locally heats the second main surface of the plate W which is the opposite side of the first main surface with which the processing tool 4 contacts, so that the shaping target portion A of the plate W can be efficiently heated regardless of the positional relationship between the processing tool 4 and the plate W. In addition, since the plate W is attached to the receiving jig 2 that is not the shaping die, the shaping target portion A does not contact the receiving jig 2.

In the conventional configuration, the shaping die is generally provided at a side of the plate W, the side being opposite to a side where the processing tool 4 is provided. Because of the shaping die, it is difficult to arrange a heating coil of the heater 5 at the side opposite to the side where the processing tool 4 is provided. Reasons for this are as below. To be specific, the heating coil is an induction heating coil formed by a copper pipe having a size of about several millimeters, and a core for concentrating magnetic flux and having a thickness of about several millimeters to 30 millimeters may be attached to a part of the coil. To arrange the heating coil as above, a certain amount of space is required. However, in a case where the heating coil is arranged immediately under the shaping target portion A while using the shaping die, the shaping die and the heater contact each other, which is not preferable. In the present embodiment, the shaping die is not used, and the heater 5 is provided at a side of the plate W, the side being opposite to a side where the processing tool 4 is provided, and is located immediately under the shaping target portion A of the plate W shaped by the processing tool 4. If the heater 5 is provided at the side, where the processing tool 4 is provided, of the plate W, the shape of the heating coil of the heater 5 is limited by the shaping design of the plate W. However, since the heating coil of the heater 5 is provided at a side (in the conventional configuration, the side where the shaping die is provided) of the plate W, the side being opposite to a side where the processing tool 4 is provided, the shape of the heating coil of the heater 5 is not limited by the shaping design of the plate W. Therefore, according to the configuration of the present embodiment, the heater 5 is arranged at the side, where both the shaping die and the processing tool 4 are not provided, of the plate W, so that the heater 5 can easily, locally heat the shaping target portion A. Further, by using the receiving jig 2 that is much smaller than the shaping die, the heat by the heating of the heater 5 is not directly transferred to the receiving jig 2, so that the heater 5 can perform the heating more efficiently than a case where the shaping die is used. Further, in the present embodiment, the heating by the high frequency induction heating is performed. With this, the local heating can be performed easily and efficiently. Since the shaping die is not used, the manufacturing cost of the shaping die can be cut, so that the shaping cost can be reduced.

As described above, the receiving jig 2 may have the same size as the circle defined by the shaping start position of the plate W. However, in this case, especially regarding the vicinity of the shaping start position, due to the interference between the heater 5 and the receiving jig 2, the position heated by the heater 9 cannot be located on the circumference defined by the position with which the processing tool contacts. In a case where the receiving jig 2 has a size smaller than the circle defined by the shaping start position of the plate W, the heating can be appropriately performed from the shaping start position.

As shown in FIG. 1, the spinning forming apparatus 101 of the present embodiment further includes: a shaping machine controller 12 configured to control the rotation of the rotational shaft 10 and the positions of the processing tool 4 and the heater 5; a load measuring unit 13 configured to measure a load applied to the plate W when the processing tool 4 contacts the plate W; and a displacement sensor 14 configured to detect the position of the shaping target portion A of the plate W. Further, the spinning forming apparatus 101 includes: a radiation thermometer 15 configured to measure a surface temperature of a position (shaping target portion A) of the plate W, the position being located on a circumference around the rotational axis S, the circumference being defined by the position with which the processing tool 4 contacts; and an output adjuster 16 configured to adjust an output of the heater 5. The output adjuster 16 adjusts the output of the heater 5 by changing the value of the current output from the induction heating power supply 11.

The spinning forming apparatus 101 includes a control device 17 configured to transmit control commands to respective components depending on shaping conditions and driving states of the components. For example, the control device 17 controls the rotation of the rotational shaft 10, the positions of the processing tool 4 and the heater 5, and the positions of the displacement sensor 14 and the radiation thermometer 15 based on operation states (control states of the holding member 1, the processing tool 4, and the heater 5) from the shaping machine controller 12, information from the load measuring unit 13 regarding the load applied from the processing tool 4 to the plate W, and information from the displacement sensor 14 regarding the position of the shaping target portion A of the plate W. In addition, the control device 17 controls the output of the heater 5 based on information from the radiation thermometer 15 regarding the surface temperature of the shaping target portion A of the plate W.

Figure 3:
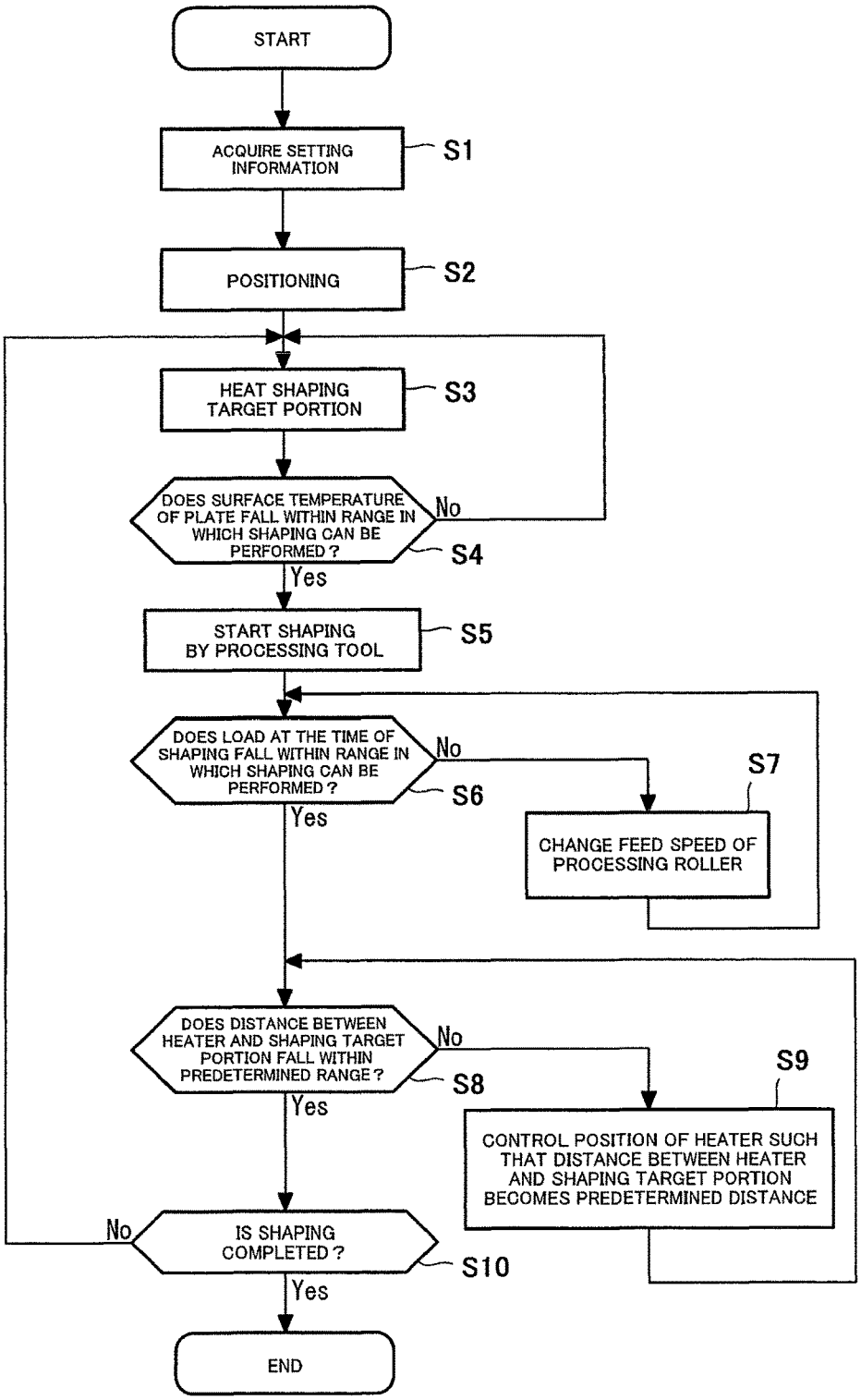
FIG. 3 is a flow chart showing one example of a control mode of the spinning forming apparatus of FIG. 1.

Hereinafter, one example of a control mode of the spinning forming apparatus 101 according to the present embodiment will be explained. FIG. 3 is a flow chart showing one example of the control mode of the spinning forming apparatus of FIG. 1. Here, the holding member 1 holds the predetermined plate W in advance. As shown in FIG. 3, depending on the type, shaping design, size, thickness, and the like of the plate W, the control device 17 first acquires setting information, such as a rotating speed of the holding member 1, a feed speed of the processing roller of the processing tool 4 (a movement speed in a direction along the rotational axis S), a radial direction movement speed of the processing roller of the processing tool 4 (a movement speed of the processing roller in the radial direction around the rotational axis S), a shaping angle of the processing roller of the processing tool 4 (an inclination of the rotational axis Q of the processing roller relative to the plate W), and a heating temperature (Step S1). The control device 17 may acquire these pieces of information from external devices or may read out and acquire these pieces of information stored in a storage portion included in the spinning forming apparatus 101.

After the pieces of information regarding the settings are acquired, the control device 17 positions the processing tool 4, the heater 5, the displacement sensor 14, and the radiation thermometer 15 (Step S2). Specifically, the control device 17 positions the processing tool 4 such that the processing roller of the processing tool 4 contacts the predetermined shaping target portion A of the plate W, positions the heater 5 such that the heater 5 heats the shaping target portion A (a region on the circumference around the rotational axis S), positions the displacement sensor 14 such that the displacement sensor 14 can measure the displacement of the shaping target portion A, and positions the radiation thermometer 15 such that the radiation thermometer 15 can measure the surface temperature of the shaping target portion A.

Then, the control device 17 rotates the rotational shaft 10 around the rotational axis S to rotate the plate W and causes the heater 5 to start heating the shaping target portion A of the plate W (Step S3). The control device 17 acquires the surface temperature of the shaping target portion A detected by the radiation thermometer 15 and determines whether or not the surface temperature of the shaping target portion A is a temperature within a range in which the shaping can be performed (Step S4). For example, in the case of using the plate W made of the titanium alloy (Ti-6Al-4V), the range in which the shaping can be performed can be set to a range of 500 to 1,000° C.

The output adjuster 16 adjusts the output of the heater 5 such that the surface temperature of the plate W measured by the radiation thermometer 15 falls within a predetermined temperature range. With this, the output of the heater 5 is adjusted based on the actual temperature of the shaping target portion A of the plate W, so that the temperature of the shaping target portion A of the plate W can be adjusted more appropriately. In the present embodiment, the radiation thermometer 15 measures the surface temperature of the first main surface, with which the processing tool 4 contacts, of the plate W, that is, the surface temperature of a side (front surface side) of the plate W, the side being opposite to a side (rear surface side) where the heater 5 is located. Therefore, the radiation thermometer 15 can perform highly precise temperature measurement without being interfered by the heater 5. It should be noted that a plurality of radiation thermometers 15 may be provided so as to measure the temperatures of both the first main surface and second main surface of the shaping target portion A of the plate W.

When the surface temperature of the shaping target portion A is a temperature in the range in which the shaping can be performed (Yes in Step S4), the shaping of the shaping target portion A by processing is started by using the processing tool 4 (Step S5). In contrast, when the surface temperature of the shaping target portion A is not a temperature in the range in which the shaping can be performed (No in Step S4), the output of the heater 5 is adjusted until the surface temperature of the shaping target portion A becomes a temperature in the range in which the shaping can be performed.

The control device 17 causes the heater 5 to move in synchronization with the shaping operation by the processing tool 4. It should be noted that the "synchronization" includes: a case where the heater 5 is moved to follow the movement of the processing tool 4; and a case where after the heating by the heater 5 is completed (after the surface temperature of the shaping target portion A falls within the range in which the shaping can be performed), the shaping by the processing tool 4 is started (the processing roller is caused to contact the shaping target portion A of the plate W). With this, since the heater 5 moves in accordance with the shaping operation by the processing tool 4, the shaping can be stably performed. In addition, since the shaping by the processing tool 4 can be performed after the heater 5 surely heats the shaping target portion A, an excellent shaped product can be obtained.

The control device 17 causes the processing tool 4 to move relative to the plate W at the feed speed corresponding to the load detected by the load measuring unit 13. Specifically, the control device 17 determines whether or not the load detected by the load measuring unit 13 falls within a preset range in which the shaping can be performed (Step S6). When it is determined that the load falls within the range in which the shaping can be performed (Yes in Step S6), the processing continues. When it is determined that the load does not fall within the range in which the shaping can be performed (No in Step S6), the feed speed of the processing roller is changed (Step S7). The feed speed of the processing roller is repeatedly changed until the load falls within the range in which the shaping can be performed.

In a case where the feed speed of the processing tool 4 with respect to the plate W when rotating the plate W is high, the shaping speed becomes high, but the load becomes large, and this increases risks of cracks and deformations. In contrast, in a case where the feed speed is low, the load becomes small, but the shaping speed becomes low. Therefore, by controlling the feed speed of the processing tool 4 such that the load falls within a predetermined range, the shaping can be appropriately performed without decreasing the shaping speed as much as possible.

Based on the information regarding the position of the shaping target portion A of the plate W detected by the displacement sensor 14 and the information regarding the control of the position of the heater 5 obtained from the shaping machine controller 12, the control device 17 determines whether or not a distance h between the heater 5 and the shaping target portion A of the plate W falls within a predetermined range (for example, 1 to 10 mm) (Step S8). In a case where the distance h between the heater 5 and the shaping target portion A falls within the predetermined range (Yes in Step S8), the processing continues. In a case where the distance h does not fall within the predetermined range (No in Step S8), the heater 5 is caused to move relative to the plate W such that the distance h becomes a predetermined distance (Step S9).

With this, even in a case where the plate W is displaced in a direction along the rotational axis S of the holding member 1 at the time of the shaping by the processing tool, the distance between the heater 5 and the shaping target portion (heating target portion) A of the plate W can be maintained constant. Especially in the case of the heater 5 using the coil 61 for high frequency induction heating as in the present embodiment, in a case where the distance h from the coil 61 to the shaping target portion A of the plate W changes, the amount of heat applied from the coil 61 to the plate W changes relatively significantly. Therefore, by maintaining the distance h between the heater 5 and the shaping target portion A of the plate W constant, the heating with respect to the shaping target portion A of the plate W can be made constant at the time of the processing regardless of processing states.

While performing these control operations, the shaping is performed. Then, the control device 17 determines for every predetermined shaping timing whether or not the shaping is completed (Step S10). When the shaping is not completed yet (No in Step S10), the control device 17 continues a shaping step (Steps S3 to S9). When the shaping is completed (Yes in Step S10), the control device 17 terminates the process.

In the present embodiment, the shaping die is not used. Instead, the position of the shaping target portion A of the plate W can be recognized by the positional information from the displacement sensor 14. Therefore, based on this, the processing tool 4 and the heater 5 can be appropriately controlled, and the plate W can be shaped into a desired shape with a high degree of accuracy. The magnitude of the load applied to the shaping target portion A of the plate W can be recognized by the load information from the load measuring unit 13. Therefore, based on this, the accuracy of the shaping of the plate W can be increased without using the shaping die.

The present embodiment has explained the heater 5 using the coil 61 for high frequency induction heating. However, the heater 5 is not limited to this as long as the heater can locally heat a position on the second main surface of the plate W opposite to the first main surface with which the processing tool 4 contacts, the position being located on the circumference around the rotational axis S, the circumference being defined by the position, with which the processing tool 4 contacts, of the plate W. For example, a frictional heater may be adopted as the heater 5.

Embodiment 2

Figure 4:
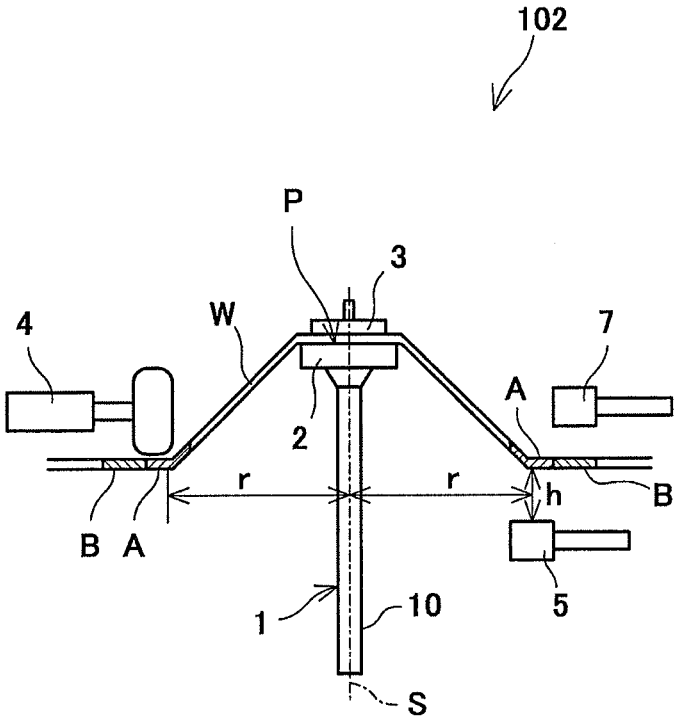
FIG. 4 is a schematic configuration diagram showing the spinning forming apparatus according to Embodiment 2 of the present invention.

Hereinafter, the spinning forming apparatus according to Embodiment 2 of the present invention will be explained. FIG. 4 is a schematic configuration diagram showing the spinning forming apparatus according to Embodiment 2 of the present invention. In the present embodiment, the same reference signs are used for the same components as in Embodiment 1, and a repetition of the same explanation is avoided. As shown in FIG. 4, a spinning forming apparatus 102 of the present embodiment is different from Embodiment 1 in that the spinning forming apparatus 102 further includes a preheater 7 configured to preliminarily heat a position of the plate W, the position being located at a radially outer side of the position (shaping target portion A) with which the processing tool 4 contacts (i.e., the position being a position (preliminarily heated portion B) located at the not-yet-shaped portion side of the plate W in a shaping proceeding direction). In FIG. 4, the components, such as the control device 17 and the load measuring unit 13, which are related to the control operations are not shown.

Here, the shaping proceeding direction is defined as a direction in which the shaping of the plate W by the processing tool 4 proceeds. In the example of FIG. 4, the shaping proceeding direction is a direction from a radially inner side of the rotational axis S to a radially outer side thereof. In this case, the preheater 7 is provided at a rotational axis S radially outer side of the heater 5.

In the present embodiment, the preheater 7 is configured to heat the position (preliminarily heated portion B) on the side of the plate W opposite to the side heated by the heater 5, the position being located on a circumference around the rotational axis S, the circumference being defined by a position located at the rotational axis S radially outer side of the position (shaping target portion A), heated by the heater 5, of the plate W. To be specific, the preheater 7 preliminarily heats the not-yet-shaped portion of the plate W. As with the heater 5, the preheater 7 adopts the heating by high frequency induction heating. However, the preheater 7 may adopts the heating by a burner or the like. For example, as with the heater 5, the preheater 7 includes a coil formed to have a circular-arc shape that is doubled in a direction perpendicular to the rotational axis S. Since the distance from the rotational axis S to the preheater 7 is longer than the distance from the rotational axis S to the heater 5, it is desirable that the curvature radius of the coil of the preheater 7 be larger than the curvature radius of the coil 61 of the heater 5.

The output of the preheater 7 is adjusted such that the temperature of the preliminarily heated portion B becomes a temperature at which the preliminarily heated portion B does not deform by influences of pressing force applied from the processing tool 4 to the shaping target portion A. For example, it is preferable that the preheater 7 perform the heating weaker than the heating performed by the heater 5. In order that the heating performance of the preheater 7 is made lower than the heating performance of the heater 5, the output of the preheater 7 may be made lower than the output of the heater 5, and in addition to this or instead of this, the distance between the preheater 7 whose output is set to be the same as the output of the heater 5 and the plate W may be set to be longer than the distance between the heater 5 and the plate W. In addition, it is preferable that the preliminarily heated portion B be adjacent to the shaping target portion A.

Since the preliminarily heated portion B that is the not-yet-shaped portion is preliminarily heated by the preheater 7, the temperature increases quickly at the time of the local heating by the heater 5. With this, the processing speed can be increased, or even in a case where the plate W is thick, the heating up to the temperature required for the shaping can be efficiently performed without decreasing the processing speed.

Figure 5:
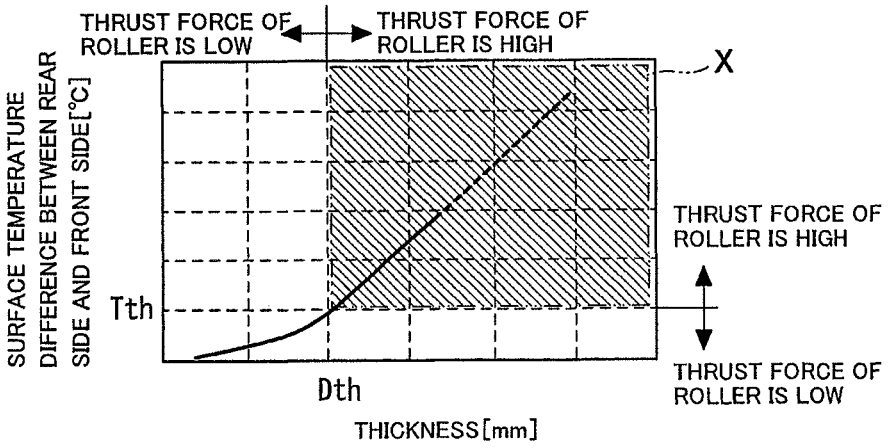
FIG. 5 is a graph showing a relationship between the thickness of a plate and a surface temperature difference between a rear side and front side of the plate.

The preliminary heating is suitably performed depending on the type and thickness of the plate W, the heating temperature, and the properties of the processing tool 4 (such as pushing force of the processing roller). Whether or not the preliminary heating is necessary can be considered especially depending on the thickness of the plate W, the surface temperature difference between the front and rear sides of the plate W, and the properties of the processing tool 4. FIG. 5 is a graph showing a relationship between the thickness of the plate and the surface temperature difference between the rear and front surfaces of the plate. FIG. 5 shows the temperature difference (rear surface temperature—front surface temperature) between the second main surface and the first main surface when the temperature of the second main surface, heated by the heater 5, of the plate W made of Ti-6Al-4V that is the titanium alloy is 900° C.

A region X shown by diagonal lines in FIG. 5 denotes a region where the use of the preliminary heating is effective (region where the thickness is not smaller than a thickness threshold Dth, and the surface temperature difference is not smaller than a surface temperature difference threshold Tth). The region X changes depending on the pushing force of the processing roller that is one of the properties of the processing tool 4. To be specific, when the pushing force of the processing roller increases, the thickness threshold Dth and the surface temperature difference threshold Tth become larger. When the pushing force of the processing roller decreases, the thickness threshold Dth and the surface temperature difference threshold Tth become smaller. That is, when the pushing force of the processing roller decreases, performing the preliminary heating is preferable even in the case of the smaller thickness or surface temperature difference.

It should be noted that even in a case where the shaping proceeding direction is a direction from the rotational axis S radially outer side toward the rotational axis S radially inner side, the same effects as above can be obtained in such a manner that the preheater 7 heats a position on a circumference around the rotational axis S, the circumference being defined by a position located at the rotational axis S radially inner side of the position, heated by the heater 5, of the plate W. The preheater 7 may be arranged in any manner as long as the preheater 7 can heat the position on the circumference around the rotational axis S, the circumference being defined by the position located at the rotational axis S radially outer side of the position, heated by the heater 5, of the plate W. For example, the preheater 7 may be arranged so as to heat a side of the plate W, the side being also heated by the heater 5. In the present embodiment, regarding the circumferential direction around the rotational axis S, the preheater 7 is arranged at the substantially same position as the heater 5. However, the preheater 7 and the heater 5 may be arranged at different positions in the circumferential direction.

Embodiment 3

Figure 6:
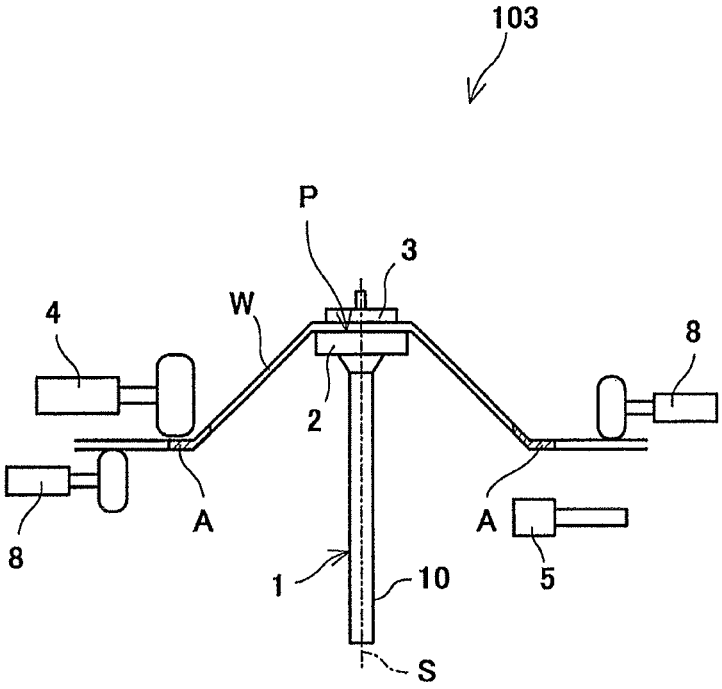
FIG. 6 is a schematic configuration diagram showing the spinning forming apparatus according to Embodiment 3 of the present invention.

Hereinafter, the spinning forming apparatus according to Embodiment 3 of the present invention will be explained. FIG. 6 is a schematic configuration diagram showing the spinning forming apparatus according to Embodiment 3 of the present invention. As shown in FIG. 6, a spinning forming apparatus 103 of the present embodiment is different from Embodiment 1 in that the spinning forming apparatus 103 further includes an auxiliary tool 8 which contacts the not-yet-shaped portion of the plate W and supports a position of the plate W, the position being located at the radially outer side of the position with which the processing tool 4 contacts. In FIG. 6, the components, such as the control device 17 and the load measuring unit 13, which are related to the control operations are not shown.

In the present embodiment, the auxiliary tool 8 is constituted by an auxiliary roller which is caused to contact the not-yet-shaped portion of the plate W to be rotated. However, the auxiliary tool 8 is not limited to the roller as long as the auxiliary tool 8 does not damage the plate W when contacting the plate W (the frictional force generated by the contact of the auxiliary tool 8 is small).

By using the auxiliary tool 8, the plate W can be stabilized and can be efficiently heated and processed. To be specific, since the not-yet-shaped portion of the plate W is held by the auxiliary tool 8, deflections of an outer peripheral edge of the plate W in the direction along the rotational axis S generated when performing the processing by the processing tool 4 can be suppressed. With this, the heating by the heater 5 can become constant regardless of the shaping target portion of the plate W. Further, the pressing force applied from the processing tool 4 to the plate W can become constant regardless of the shaping target portion of the plate W. Therefore, the accuracy of the shaping of the plate W can be increased.

The auxiliary tool 8 may be arranged in any manner as long as the auxiliary tool 8 contacts the not-yet-shaped portion of the plate W. For example, as shown in FIG. 6, the auxiliary tool 8 may be provided at the side, with which the processing tool 4 contacts, of the plate W or may be provided at the opposite side. The number of auxiliary tools 8 may be one or plural.

The above embodiments are just examples, and the present invention is not limited to the embodiments. The present invention is shown by the scope of the claims, not the scope of the above explanations, and all the modifications within the meaning and scope equivalent to the scope of the claims may be made. For example, respective components in the above embodiments may be combined arbitrarily.

INDUSTRIAL APPLICABILITY

The spinning forming apparatus and spinning forming method of the present invention are useful for shaping the plate without causing deformations or cracks of the plate by appropriately heating the shaping target portion of the plate.

REFERENCE SIGNS LIST

1 holding member
2 receiving jig
3 fixing jig
4 processing tool
5 heater
61 coil
62 core
63 convex portion
7 preheater
8 auxiliary tool
10 rotational shaft
11 induction heating power supply
12 shaping machine controller
13 load measuring unit
14 displacement sensor
15 radiation thermometer
16 output adjuster
17 control device
101 to 103 spinning forming apparatus
P receiving surface
Q rotational axis of processing tool
S rotational axis of holding member
W plate

The invention claimed is:

1. A spinning forming apparatus for shaping a target plate while rotating the plate around a rotational axis,
the spinning forming apparatus comprising:
a holding member including
a receiving jig to which the plate is attached, and
a rotational shaft configured to rotate the plate around the rotational axis together with the receiving jig;
a processing tool configured to contact a first main surface of the plate to process and shape the plate; and
a heater configured to heat the plate, wherein:
the heater is arranged at the opposite side of the processing tool across the plate; and
the heater locally heats a position of a second main surface of the plate opposite to the first main surface, the position being located on a circumference around the rotational axis, the circumference being defined by a position, with which the processing tool contacts, of the plate;
wherein the spinning forming apparatus is configured such that, when the plate is being processed and shaped by the processing tool, a space is present on a part of the second main surface, the part being opposite to the position of the first main surface that is being contacted by the processing tool.

2. The spinning forming apparatus according to claim 1, wherein the receiving jig has a size smaller than a circle defined by a shaping start position of the plate.

3. The spinning forming apparatus according to claim 1, wherein the heater performs heating by high frequency induction heating.

4. The spinning forming apparatus according to claim 1, further comprising a preheater configured to preliminarily heat a position of the plate, the position being located at a radially outer side of the position with which the processing tool contacts.

5. The spinning forming apparatus according to claim 1, wherein the heater includes a coil formed to have a circular-arc shape that is doubled in a direction perpendicular to the rotational axis.

6. The spinning forming apparatus according to claim 5, wherein the heater includes:
a magnetic core covering the coil from the opposite side of the plate; and
a convex portion projecting toward the plate beyond the coil and the core.

7. The spinning forming apparatus according to claim 1, further comprising an auxiliary tool configured to support a position of the plate, the position being located at a radially outer side of the position with which the processing tool contacts.

8. The spinning forming apparatus according to claim 1, further comprising a control device programmed to move the heater relative to the plate such that a distance between the heater and a shaping target portion of the plate becomes a predetermined distance.

9. The spinning forming apparatus according to claim 1, further comprising a control device programmed to move the heater in synchronization with a shaping operation by the processing tool.

10. The spinning forming apparatus according to claim 1, further comprising:
a radiation thermometer configured to measure a surface temperature of a position of the plate, the position being located on the circumference around the rotational axis, the circumference being defined by the position with which the processing tool contacts; and
an output adjuster configured to adjust an output of the heater, wherein
the output adjuster adjusts the output of the heater such that the surface temperature falls within a predetermined temperature range.

11. The spinning forming apparatus according to claim 1, further comprising:

a load measuring unit configured to measure a load applied to the plate when the processing tool contacts the plate; and a control device programmed to move the processing tool relative to the plate at a feed speed corresponding to the load.

12. The spinning forming apparatus according to claim 1, wherein the plate is made of a titanium alloy.

13. A spinning forming method of shaping a plate while rotating the plate around a rotational axis, the method comprising:

contacting a first main surface of the plate with a processing tool to process and shape the plate in a state where the plate is attached to a receiving jig of a holding member, and the plate is rotated around the rotational axis;

arranging a heater at the opposite side of the processing tool across the plate; and locally heating a position of a second main surface of the plate opposite to the first main surface, the position being located on a circumference around the rotational axis, the circumference being defined by a position, with which the processing tool contacts, of the plate, wherein, when the plate is being processed and shaped by the processing tool, a space is present on a part of the second main surface, the part being opposite to the position of the first main surface that is being contacted by the processing tool.

14. The spinning forming method according to claim 13, further comprising preliminarily heating a position of the plate, the position being located at a radially outer side of the position with which the processing tool contacts.

15. The spinning forming method according to claim 13, further comprising moving the heater relative to the plate such that a distance between the heater performing the local heating and a shaping target portion of the plate becomes a predetermined distance.

16. The spinning forming method according to claim 13, further comprising moving the heater, performing the local heating, in synchronization with the shaping operation by the processing tool.

17. A spinning forming method of shaping a plate while rotating the plate around the rotational axis, the method comprising:

contacting a first main surface of the plate with a processing tool to process and shape the plate in a state where the plate is attached to a receiving jig of a holding member, and the plate is rotated around the rotational axis;

arranging a heater at the opposite side of the processing tool across the plate;

locally heating a position of a second main surface of the plate opposite to the first main surface, the position being located on a circumference around the rotational axis, the circumference being defined by a position, with which the processing tool contacts, of the plate;

measuring a surface temperature of a position of the plate, the position being located on the circumference around the rotational axis, the circumference being defined by the position with which the processing tool contacts; and adjusting an output of the heater, performing the local heating, such that the surface temperature falls within a predetermined temperature range.

18. The spinning forming method according to claim 13, further comprising:

measuring a load applied to the plate when the processing tool contacts the plate; and moving the processing tool relative to the plate at a feed speed corresponding to the load.

19. A spinning forming method of shaping a plate while rotating the plate around a rotational axis, the method comprising:

contacting a first main surface of the plate with a processing tool to process and shape the plate in a state where the plate is attached to a receiving jig of a holding member, and the plate is rotated around the rotational axis;

arranging a heater at the opposite side of the processing tool across the plate; and heating, by high frequency induction heating, a position of a second main surface of the plate opposite to the first main surface, the position being located on a circumference around the rotational axis, the circumference being defined by a position, with which the processing tool contacts, of the plate, wherein the high frequency induction heating is performed at the same time as the processing tool process and shapes the plate.

* * * * *